US006629847B1

(12) United States Patent
Satoh

(10) Patent No.: US 6,629,847 B1
(45) Date of Patent: Oct. 7, 2003

(54) MAGNETIC DISPLAY PANEL AND METHOD FOR PRODUCING THE SAME

(75) Inventor: Hirohisa Satoh, Tokyo (JP)

(73) Assignee: Takara Co., Ltd., Tokyo (JP)

( * ) Notice: Subject to any disclaimer, the term of this patent is extended or adjusted under 35 U.S.C. 154(b) by 0 days.

(21) Appl. No.: 09/509,661

(22) PCT Filed: Jul. 30, 1999

(86) PCT No.: PCT/JP99/04125

§ 371 (c)(1),
(2), (4) Date: Mar. 30, 2000

(87) PCT Pub. No.: WO00/07171

PCT Pub. Date: Feb. 10, 2000

(30) Foreign Application Priority Data

Jul. 31, 1998 (JP) ..... 10-218052
Jul. 31, 1998 (JP) ..... 10-218054
Nov. 2, 1998 (JP) ..... 10-312585

(51) Int. Cl.[7] ..... B43L 1/00
(52) U.S. Cl. ..... 434/409
(58) Field of Search ..... 434/409, 408, 434/410; 446/131, 132; 428/328, 323, 329

(56) References Cited

U.S. PATENT DOCUMENTS 3,982,057 A * 9/1976 Briggs ..... 428/73
3,982,334 A * 9/1976 Tate ..... 434/409 XZ
4,033,805 A * 7/1977 Mitsui ..... 156/185
4,143,472 A * 3/1979 Murata ..... 434/409
4,288,936 A * 9/1981 Okutsu ..... 40/426 XZ
4,579,223 A * 4/1986 Otsuka ..... 206/204
4,931,019 A * 6/1990 Park ..... 434/409 XZ
5,006,000 A * 4/1991 House ..... 434/161 XZ
5,411,398 A * 5/1995 Nakanishi ..... 434/409 XZ
5,429,503 A * 7/1995 Murata ..... 434/409 XZ
5,820,385 A * 10/1998 Ohashi ..... 434/409 XZ
5,928,454 A * 7/1999 Nakadai ..... 156/275.5
5,977,021 A * 11/1999 Aoyama ..... 503/226
6,103,347 A * 8/2000 Nojima et al. ..... 428/174 XZ
6,196,848 B1 * 3/2001 Yamazaki ..... 434/409 XZ

FOREIGN PATENT DOCUMENTS

JP 2223934 9/1990
JP 1044689 2/1998

* cited by examiner

*Primary Examiner*—Derris H. Banks
*Assistant Examiner*—Kurt Fernstrom

(57) ABSTRACT

A magnetic display panel capable of ensuring safety to the body of an infant, permitting drawing of clear lines and ensuring safe disposal thereof. A magnetic display panel (1) includes a core housing (3) which has a peripheral edge **(3*a*) formed to have an increased height and is formed therein with a recess (8), a plate-like face member (2) arranged so as to cover the recess (8), and a core block (5) provided with a number of cells (4) in which a plastic dispersion liquid (7) containing magnetic particles is encapsulated and sealedly joined between the core block (5) and the plate-like face member (2) by an adhesive. The core housing (3) and plate-like face member (2) are each made of olefin synthetic resin. One of the core housing (3) and plate-like face member (2) constitutes a drawing faceplate which is formed to be transparent or semi-transparent. The core block (5)** is formed of pulp made paper.

26 Claims, 8 Drawing Sheets

MAGNETIC DISPLAY PANEL AND METHOD FOR PRODUCING THE SAME

TECHNICAL FIELD

This invention relates to a magnetic display panel mainly applied to picture drawing b y infants and a method for manufacturing the same, and more particularly to a magnetic display panel improved in structure by integrally combining a core block and a member for sealing both sides of the core block with each other and a method for manufacturing the same.

BACKGROUND OF THE INVENTION

As a drawing board for infants, a magnetic drawing panel has been conventionally known in the art, which includes a transparent or semi-transparent drawing plate or a base plate, a plate-like face member arranged opposite to the base plate, and a honeycomb core including a number of hexagonal cells and sealedly arranged between the base plate and the plate-like face member wherein the cells each are sealedly charged therein with a plastic dispersion liquid containing magnetic particles.

In the conventional magnetic drawing panel thus constructed, a magnetic pen is contacted at a tip thereof with a drawing faceplate of the plate-like face member to act a magnetic field on the dispersion liquid, to thereby permit the magnetic particles kept sinking on a bottom of the cells to rise to the drawing faceplate of the plate-like face member, resulting in displaying a picture or a character on the drawing faceplate due to a difference in contrast between the dispersion medium and the magnetic particles. Also, movement of an erasing bar provided thereon with a magnet or the like under the base plate permits the rising magnetic particles to sink on the bottom of the cells, leading to erasure of the picture or character drawn.

Infants often take an unpredictable action. For example, they often strongly knock or hit the tip of the magnetic pen against the base plate of the magnetic drawing panel. This possibly causes the drawing faceplate to be broken or a wall of the honeycomb core to be deformed due to impact of the magnetic pen, resulting in joining between the drawing faceplate and the honeycomb core being broken.

Breakage of the drawing faceplate causes the plastic dispersion liquid encapsulated in the cells to leak out, so that infants possibly stain their clothing, drink the liquid by mistake or get it into their eyes. The plastic dispersion liquid adhering to clothing is hard to come off, to thereby render washing of the clothing highly troublesome or substantially impossible. More fearfully or troublesomely, drinking of the liquid by infants by mistake possibly causes the infants to damage their stomach and intestines, because the dispersion liquid contains magnetic particles made of metal. Likewise, getting of the liquid into infants' eyes possibly leads to damages to a surface of the eyes due to infants' unintentional rubbing of the eyes. Further, breakage of the drawing faceplate tends to cause a broken portion thereof to be acute, so that the broken portion of the drawing faceplate may possibly damage parts of the body such as the hands, arms or the like. In addition, the magnetic display panel is substantially applied to infants. Thus, the magnetic display panel is required to exhibit satisfactory safety to the internal organs and body of the infants.

Also, deformation of a part of the drawing faceplate due to the above-described impact of the magnetic pen often leads to breakage of a joint between the drawing faceplate made of a relatively rigid vinyl chloride material and the honeycomb core, resulting in the adjacent cells communicating with each other through the broken joint. This will be more detailedly described with reference to FIGS. 12A and 12B. When a drawing faceplate 22 is deformed, to thereby be formed with a deformation, cells 20 adjacent to each other are caused to communicate with each other through a joint therebetween positioned at the deformation, so that a plastic dispersion liquid 21 in the cells 20 flows between the cells through the joint. Meanwhile, charging of the plastic dispersion liquid 21 into a honeycomb core causes air to be introduced into the liquid 21, resulting in the air forming bubbles in the liquid. Stirring of the plastic dispersion liquid 21 permits bubbles of a large size to burst, to thereby be discharged to an ambient atmosphere. However, microsized bubbles 25 are taken in the plastic dispersion liquid 21 in spite of the stirring, resulting in remaining in the liquid, because the plastic dispersion liquid 21 exhibits properties like an emulsion. When the magnetic display panel thus constructed is operated to slide a magnetic pen on the adjacent cells 20 while a partition 23 between both cells 20 is kept broken, a pressure in the cells 20 is varied when a pressure of the magnetic pen is applied to the cells. Also, forced movement of the magnetic drawing panel causes the plastic dispersion liquid in each of both cells 20 to flow therebetween. Thus, the micro-sized bubbles 25 present in the plastic dispersion liquid 21 of both cells 20 are caused to collide with each other during flowing of the liquid, to thereby be gradually increased in size. Such growth or increase in size of the bubbles causes the bubbles to rise in the plastic dispersion liquid 21, resulting in the bubbles being adhered to a rear side of the drawing faceplate 22. Such situation fails to permits the magnetic particles 23 to rise to the rear surface of the drawing faceplate 22 even when it is attempted to rub the drawing faceplate 23 with the magnetic pen to carry out rising of the magnetic particles, because the thus-growing bubbles 25 interfere with rising of the magnetic particles in the plastic dispersion liquid 21. This renders external observation of the magnetic particles through the drawing face plate 22 impossible or highly difficult, resulting in lines drawn on the drawing faceplate 22 being highly indistinct.

Further, in the conventional magnetic drawing panel, the base plate, drawing faceplate and honeycomb core each are made of vinyl chloride. This causes the magnetic drawing panel to readily generate static electricity. In particular, in the winter in which air is dried, static electricity is readily charged on the magnetic drawing panel. Charging of static electricity on the magnetic drawing panel causes the magnetic particles to be attracted onto the base plate and drawing faceplate to a degree sufficient to interfere with smooth flowing of the magnetic particles by magnetic force of the magnetic pen, leading to a variation in brightness or contrast of a line drawn on the drawing faceplate or a failure in drawing of a line thereon. Thus, in the conventional magnetic drawing panel, it is required to move an erasing bar throughout the magnetic drawing panel to facilitate flowing of the magnetic particles prior to operation of the magnetic drawing panel. Unfortunately, this renders handling of the magnetic drawing panel troublesome.

In addition, formation of vinyl chloride into the honeycomb core causes an end surface of each of the cells to be relatively thick. Thus, when any external light is reflected by the end surfaces of the cells, a configuration of the honeycomb is caused to be projected on the drawing faceplate. This reduces an effective area of the drawing faceplate and often deteriorates free drawing.

Furthermore, the magnetic display panel made of vinyl chloride generates toxic dioxin when it is incinerated at a low temperature for disposal. Dioxin is considered to have any relationship to a so-called environmental hormone although it is not sure because of being under investigation. In particular, the magnetic display panel is applied to infants, therefore, it is required not only to be fully safe by itself but not to damage to the human body when it is subject to disposal. Thus, it is highly demanded to develop a means of safely disposing of the magnetic drawing panel.

In the conventional magnetic display panel, encapsulation of the plastic dispersion liquid containing the magnetic particles in the cells of the honeycomb core is carried out by adhering open end surfaces of the honeycomb core formed on both sides thereof to the base plate and plate-like face member, respectively. More particularly, the base plate, plate-like face member and honeycomb core each are made of vinyl chloride. Subsequently, the honeycomb core is heated to a softening point thereof utilizing thermoplasticity of vinyl chloride and then the open end surfaces of the cells of the honeycomb core is collapsed while being melted, to thereby be joined to the base plate and plate-like face member. Alternatively, an adhesive is coated on a rear surface of the plate-like face member and then the face member is heated while being forced against the open end surface is of the honeycomb core after the adhesive is dried, resulting in melting the adhesive, so that the face member may be adhered to the honeycomb core by means of the thus-melted adhesive.

Unfortunately, both techniques described above have a disadvantage that the heating temperature is excessively high, to thereby cause the honeycomb core to be softened, resulting in rigidity of the honeycomb core being deteriorated, leading to deformation of the drawing faceplate. Whereas, a reduction in heating temperature tends to lead to a failure in adhesion between the honeycomb core and the plate-like face member and/or base plate.

Rugged deformation of the base plate and/or plate-like face member not only deteriorates a commercial value of the magnetic display panel but fails to ensure smooth movement of the magnetic pen, to thereby deteriorate operability of the pen. Also, any possible failure in joint between the base plate and the honeycomb core causes the cells adjacent to each other at the failed joint to communicate with each other.

Thus, the prior art requires to control a heating temperature during manufacturing of the magnetic display panel, so that the manufacturing may be highly troublesome.

The present invention has been made in view of the foregoing disadvantages of the prior art.

Accordingly, it is a primary object of the present invention to provide a magnetic display panel which is capable of ensuring safety to infants to minimize damage to the bodies of the infants in view of the fact that such a magnetic display is applied to substantially only infants. It is another object of the present invention to provide a magnetic display panel which is capable of substantially preventing damage to a drawing faceplate and breakage of a joint between the drawing faceplate and a honeycomb core when the drawing faceplate is strongly pushed with a tip of a magnetic pen, to thereby ensure safety to the body of infants. It is a further object of the present invention to provide a magnetic display panel which is capable of permitting a distinct line to be drawn thereon. It is still another object of the present invention to provide a magnetic display panel which is capable of ensuring safe disposal of the magnetic display panel without causing any environmental pollution when it is waste.

It is yet another object of the present invention to provide a method for manufacturing a magnetic display panel which is capable of facilitating temperature controlling to increase manufacturing efficiency and ensuring safe disposal thereof without causing environmental pollution and harming health.

DISCLOSURE OF INVENTION

In accordance with one aspect of the present invention, there is provided a magnetic display panel which is capable of solving the above-described problems of the prior art. The magnetic display panel includes a core housing which has a peripheral edge formed to have an increased height and is formed therein with a recess, a plate-like face member arranged so as to cover the recess of the core housing, and a core block provided with a number of cells in which a plastic dispersion liquid containing magnetic particles is encapsulated and sealedly joined between the core housing and the plate-like face member by means of an adhesive. The core housing and plate-like face member are each made of olefin synthetic resin. One of the core housing and plate-like face member constitutes a drawing faceplate, which is formed to be transparent or semi-transparent. The core block is formed of pulp made paper.

The core block may be formed of glassine paper. Alternatively, it may be formed of parchment paper.

The core housing may be formed of a material selected from the groups consisting of polyethylene terephthalate, polyethylene and polypropylene.

The adhesive may be formed of a material selected from the group consisting of an vinyl acetate resin adhesive, an acrylic resin adhesive and an ultraviolet-curing adhesive.

The recess of the core housing preferably has an upper end formed to be higher than an upper end of the honeycomb core.

A difference in height between the upper end of the recess of the core housing and that of the honeycomb core is preferably set to be larger than 0 and 0.1 mm or less.

The plastic dispersion liquid preferably contains a coloring agent which has a color similar to that of the core block.

In accordance with another aspect of the present invention, a method for manufacturing a magnetic display panel is provided. The method includes the steps of forming olefin synthetic resin into a core housing which has a peripheral edge formed to have an increased height and is formed therein with a recess and arranging a core block in the recess of the core housing. The core block is made of paper and provided with a number of cells. The method also includes the steps of bonding the core block and the recess of the housing to each other by means of an adhesive, charging a plastic dispersion liquid containing magnetic particles in the core block and arranging a plate-like face member in a manner to be opposite to the core housing with the core block being interposed between the plate-like face member and the core housing. The plate-like face member is made of olefin synthetic resin. The method further includes the steps of applying an adhesive to a rear surface of the plate-like face member and bonding the rear surface of the plate-like face member to an open surface of the core block to encapsulate the plastic dispersion liquid in the cells.

The adhesive is preferably a room temperature curing adhesive or an ultraviolet-curing adhesive.

The core block is preferably a honey comb.

The step of bonding the plate-like face member to the open surface of the core block may be carried out by moving the plate-like face member along the open surface of the core block while forcing the plate-like face member against the open surface of the core block using any suitable means. Alternatively, it may be carried out by forcing the plate-like face member against the open surface of the core block using any suitable press means.

BEST MODES FOR CARRYING OUT INVENTION

Figure 1:
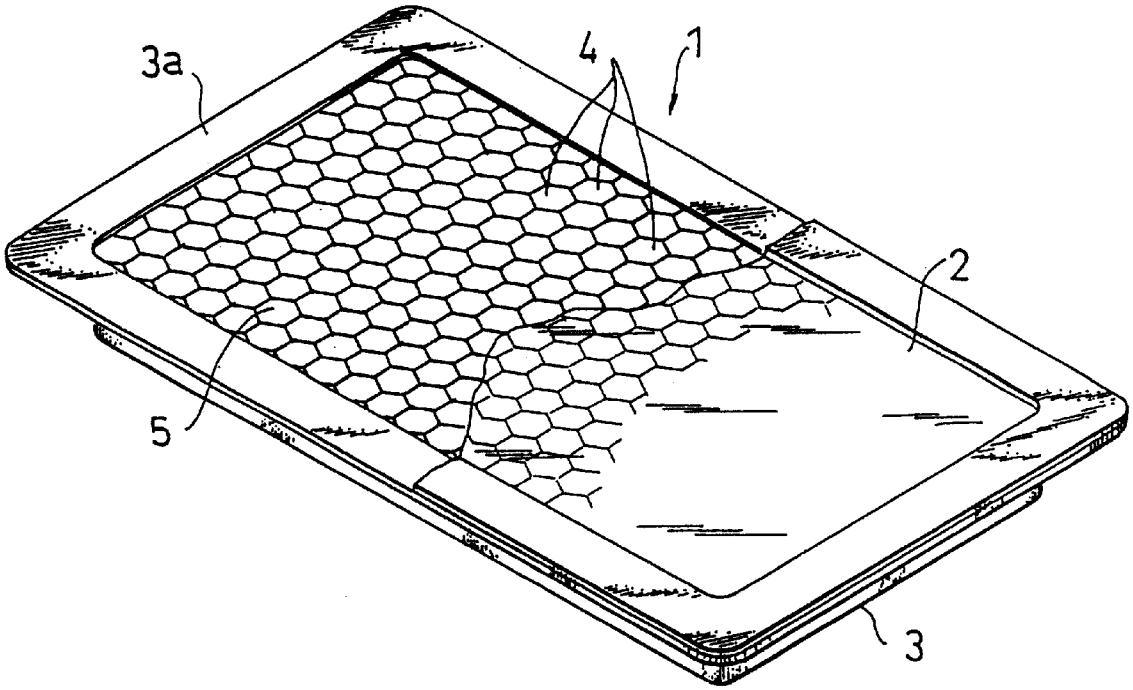
FIG. 1 is a perspective view showing an embodiment of a magnetic display panel according to the present invention, which is viewed from a rear side of the magnetic display panel.
Figure 2:
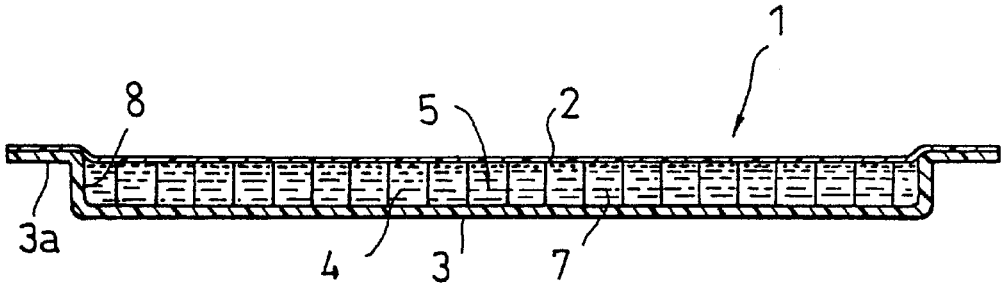
FIG. 2 is a sectional view of the magnetic display panel shown in FIG. 1.
Figure 3:
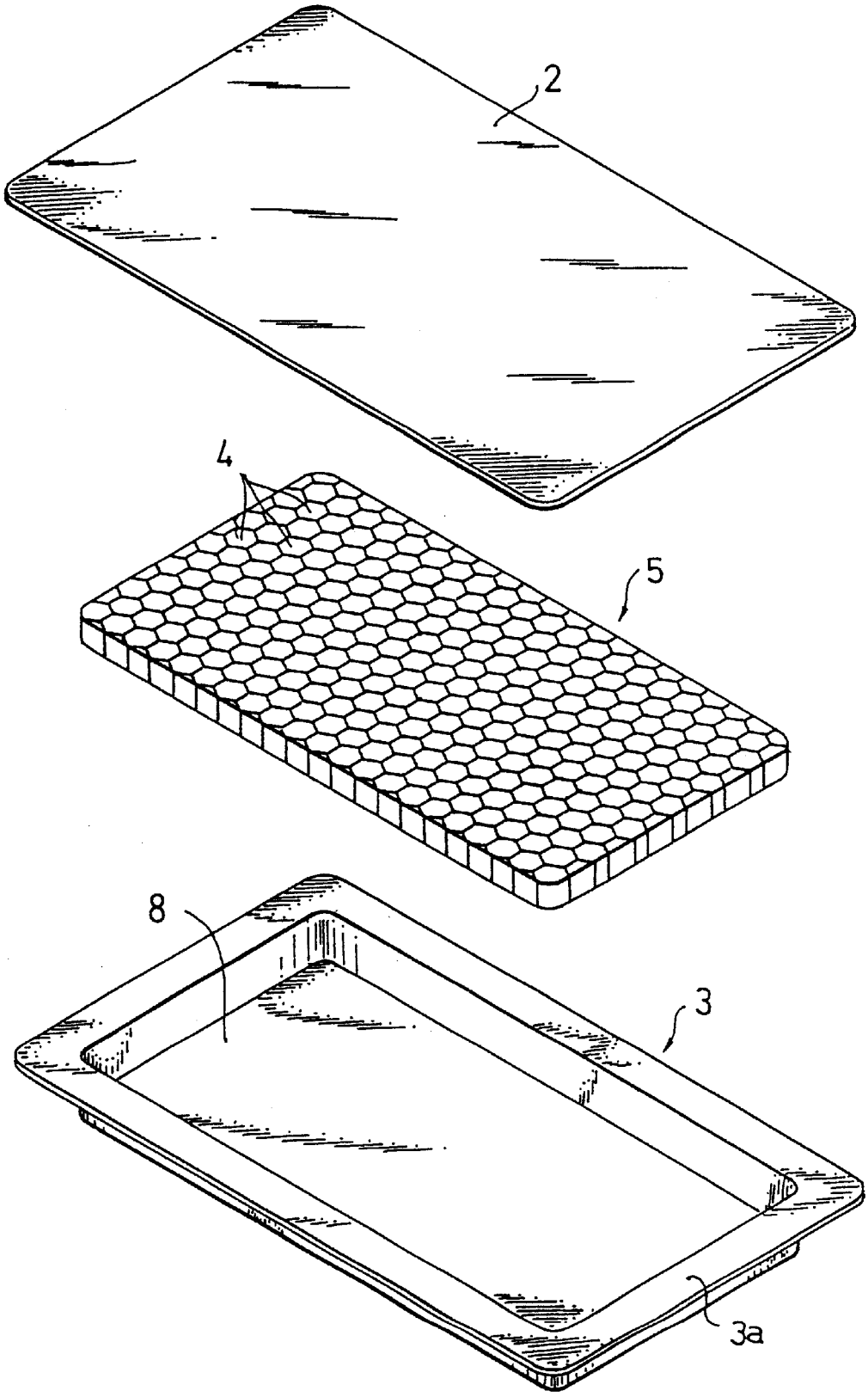
FIG. 3 is an exploded perspective view of the magnetic display panel shown in FIG. 1.

FIG. 1 is a perspective view showing a magnetic display panel 1 according to the present invention, FIG. 2 is a sectional view of the magnetic display panel and FIG. 3 is an exploded perspective view of the magnetic display panel. The magnetic display panel 1 includes a plate-like face member 2, a core housing 3, and a honeycomb core 5 sealedly arranged between the plate-like face member 2 and the core housing 3 so as to act as a core block. The honeycomb core 5 includes a number of cells 4. The cells 4 of the honeycomb core 5 each have a plastic dispersion liquid 7 encapsulated therein. The plastic dispersion liquid 7 contains magnetic particles.

In the magnetic display panel 1 thus constructed, a magnetic pen (not shown) is contacted at a tip thereof with a drawing faceplate which is a surface of the core housing 3 or an erasing bar (not shown) provided thereon with a magnet or the like and slidably arranged on a rear surface of the plate-like face member 2 is laterally moved on the drawing faceplate, so that a magnetic field may be acted on the plastic dispersion liquid 7. This results in the magnetic particles rising to the drawing faceplate or sinking to a bottom of the cells 4, to thereby be separated from the drawing faceplate, resulting in a picture or a character being drawn on the drawing faceplate or it being erased therefrom.

The core housing 3 constitutes the drawing faceplate and is made of a transparent or semitransparent olefin synthetic resin material. The olefin synthetic resin materials include polyethylene synthetic resin such as, for example, polyethylene terephthalate (PET) or the like and polypropylene synthetic resin such as polypropylene or the like. The core housing 3, as shown in FIGS. 2 and 3, has a peripheral edge 3*a* raised or formed to have an increased height, to thereby be formed therein with a recess 8. The core housing 3 of such a configuration may be formed by conventional vacuum molding. The core housing 3 is preferably made of a material selected from the group consisting of polyethylene, polyethylene terephthalate, polypropylene and polybutene.

The honeycomb core 5 is constructed into a honeycomb structure, resulting in being provided with a number of the cells 4 independent from each other. The honeycomb core 5 is made of a water-resistant and oil-resistant paper material. For this purpose, glassine paper which may be commercially available from OJI PAPER CO. under a tradename "GLASSINE" or a trademark "CRISWRAP" is preferably used. A glassine paper is made of pulp carefully selected and is featured to have increased transparency. Thus, the honeycomb core 5 may be formed to have a thickness of about 30 $\mu$m to 40 $\mu$m which is about one half as large as a thickness (about 60 $\mu$m) of the conventional honeycomb made of vinyl chloride. Also, the honeycomb core 5 is featured to be increased in resistance to fats and oils and highly increased in strength and tensile strength.

The glassine paper suitable for use in the present invention has a basis weight set within a range between 25 g/m$^2$ and 50 g/m$^2$. The reason is that the basis weight of 25 g/m$^2$ or less causes a thickness of the glassine paper to be as small as 25 $\mu$m or less, to thereby fail to permit the honeycomb core 5 to exhibit sufficient strength, whereas the basis weight of 50 g/m$^2$ or more causes a reduction in transparency of the paper and an increase in thickness thereof although it permits the paper to exhibit sufficient strength, resulting in a configuration of the honeycomb core to appear or be projected on the drawing faceplate. The optimum basis weight is within a range between 35.5±2.0 g/m$^2$ and 41.0±2.0 g/m$^2$.

Physical properties of the glassine paper are shown in Table 1.

TABLE 1

| Item | Unit | GLASSINE 25.8 g | GLASSINE 30.5 g | CRISWRAP 35 g | CRISWRAP 40 g |
|---|---|---|---|---|---|
| Basis weight | $g/m^2$ | 26.5 ± 1.5 | 31.0 ± 2.0 | 35.5 ± 2.0 | 41.0 ± 2.0 |
| Thickness | μm | 26 ± 2.0 | 30 ± 2.0 | 34 ± 3.0 | 40 ± 3.0 |
| Density | $g/cm^3$ | (1.02) | (1.03) | (1.04) | (1.03) |
| Transparency | % | ≧78 | ≧76 | ≧70 | ≧67 |
| Bursting Strength | $kgf/cm^2$ | ≧0.3 | ≧0.5 | ≧0.7 | ≧0.7 |
| Tensile strength (longitudinal) | kgf/15 mm | ≧2.0 | ≧2.5 | ≧3.5 | ≧3.5 |
| Tensile strength (lateral) | kgf/15 mm | ≧1.0 | ≧1.2 | ≧1.5 | ≧1.5 |
| Internal tearing strength (longitudinal) | gf | ≧10 | ≧12 | ≧15 | ≧17 |
| Internal tearing strength (lateral) | gf | ≧10 | ≧12 | ≧15 | ≧17 |

Alternatively, parchment paper having like properties may be used for this purpose. In this instance, parchment paper having a basis weight of 30.0 to 60.0 $g/m^2$ may be suitably used. Optimum parchment paper has a basis weight of 35.0 to 45.0 $g/m^2$.

Figure 4A:
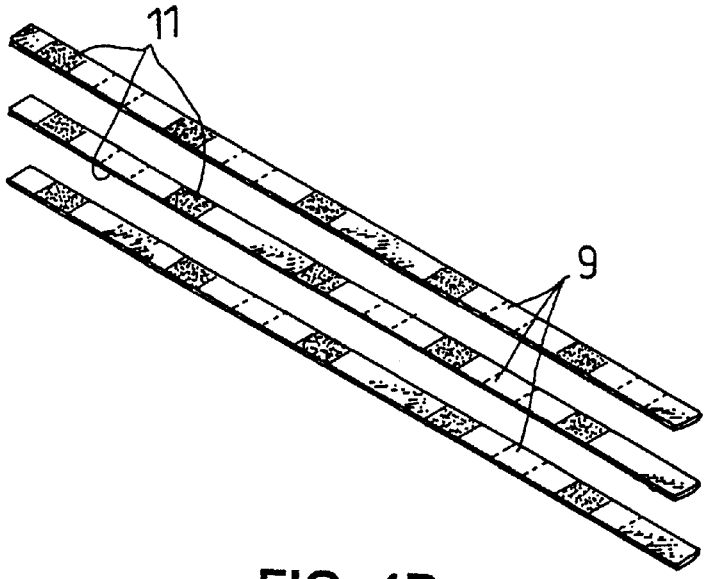
FIGS. 4A to 4C each are a fragmentary schematic perspective view showing each of steps in an example of manufacturing of a honeycomb core.
Figure 4B:
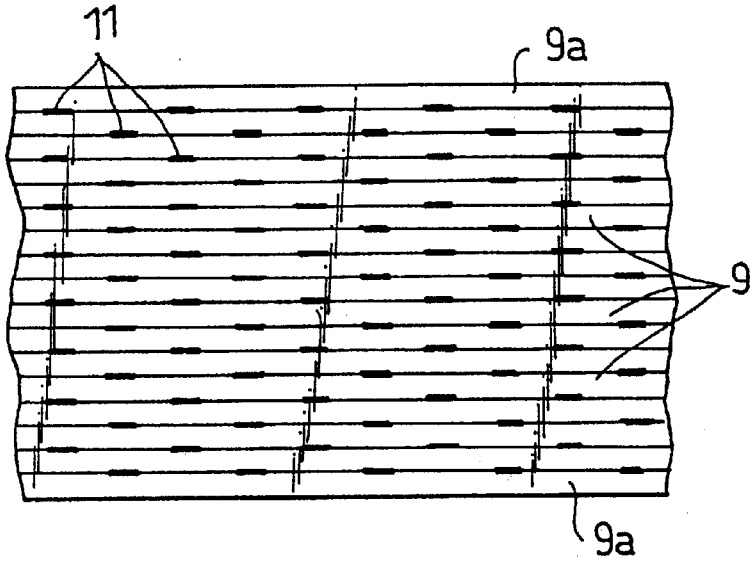
Figure 4C:
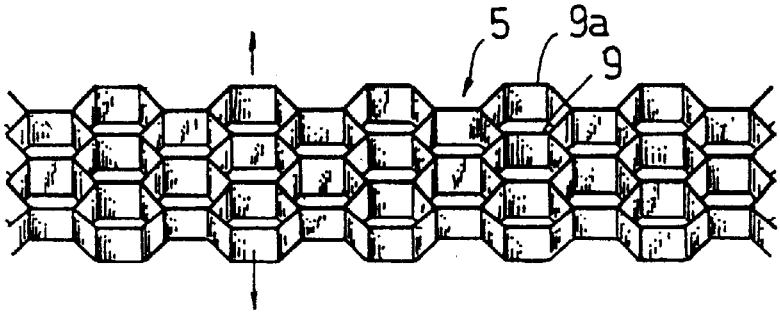

The honeycomb core 5 may be prepared, for example, by alternately applying an adhesive 11 at predetermined intervals on front and rear surfaces of a plurality of strip-like paper elements 9 as shown in FIG. 4A, superposing the paper elements 9 on each other while interposing them between two paper pieces 9*a* of the same size as the paper elements 9 as shown in FIG. 4B, bonding the paper elements 9 and paper pieces 9*a* to each other by heating or under pressure, to thereby form a laminate, and then pulling the laminate in both forward and rearward directions thereof to expand it as shown in FIG. 4C.

When the glassine paper is used, the adhesive 11 may be in the form of, for example, a two-component type which may be made by compounding 10 parts of a main agent obtained by mixing 49 to 51% of ethyl acetate and 49 to 51% of urethane resin with each other with 10 parts of a curing agent obtained by mixing 75% of polyisocyanate polymer and ethyl acetate with each other.

Figure 5A:
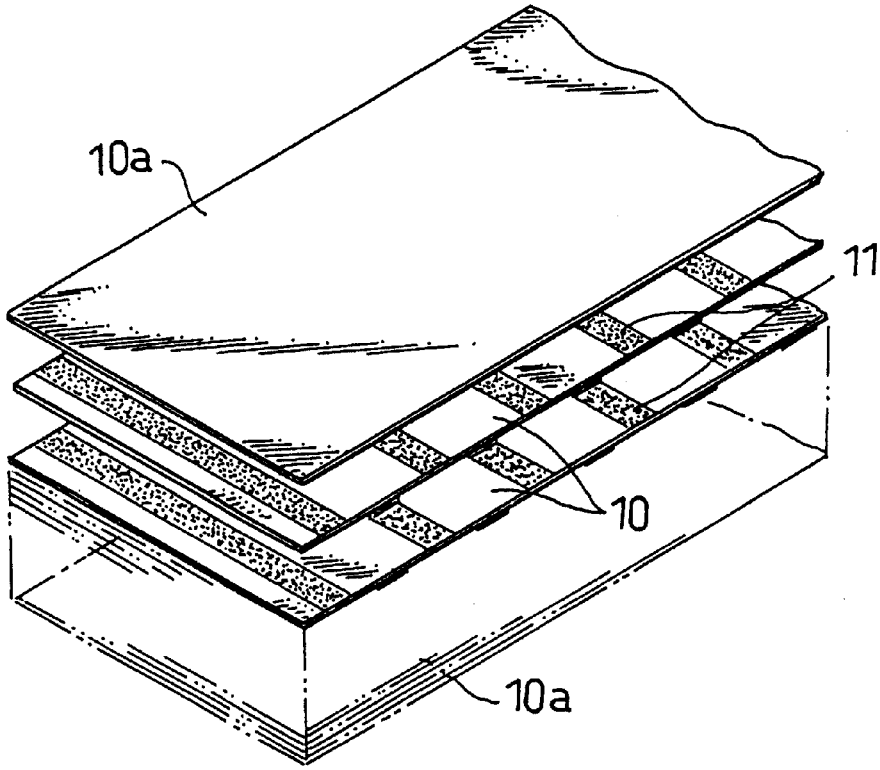
FIGS. 5A and 5B each are a fragmentary schematic perspective view showing each of steps in another example of manufacturing of a honeycomb core.
Figure 5B:
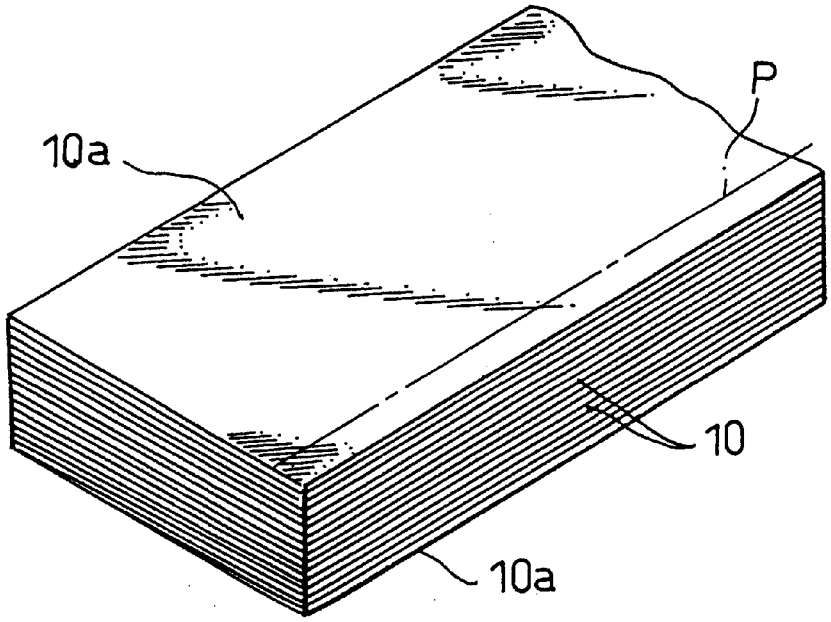

Alternatively, the honeycomb core 5 may be made as shown in FIGS. 5A and 5B. More specifically, an adhesive 11 is alternately applied in the form of a strip-like manner to front and rear surfaces of a number of paper sheets 10 at predetermined intervals as shown in FIG. 5A. Then, the paper sheets 10 are superposed on each other while being interposed between two paper sheets 10*a* of the same size as that of the paper sheets 10 and then are bonded to each other and the paper sheets 10*a* by heating or under pressure to provide a bonded laminate. Then, the laminate is subjected at portions thereof each having a predetermined width to cutting in a direction perpendicular to a direction in which the adhesive is applied, as indicated at a line P in FIG. 5B. Then, the cut portion of the laminate-is pulled in both forward and rearward directions thereof, to thereby be expanded. Of course any other suitable techniques may be used for this purpose.

The cells 4 of the honeycomb core 5 each are preferably formed so that a portion thereof having a maximum width is inscribed in a circle having a diameter of 2.0 to 8.0 mm. From a technical point of view, it is substantially impossible to form the cells of 2.0 mm or less in maximum width using paper. Also, in a magnetic display panel for infants, it is not generally required to precisely form cells. The cells 4 as large as 8.0 mm or more in maximum width are too large to control rising and sinking of the magnetic particles in the cells 4, to thereby render drawing non-uniform. An optimum width of the cells 4 is within a range between 3.0 mm and 4.0 mm. A thickness of the honeycomb core 5 is related to a depth or height of the recess 8 of the core housing 3 as described hereinafter.

The recess 8 of the core housing 3 may have an upper end formed so as to be substantially flush with an upper end of the honeycomb core 5. However, in the illustrated embodiment, the upper end of the recess 8 of the core housing 3 is formed so as to be slightly higher by a distance or difference d than the upper end of the honeycomb core 5 as shown in FIG. 5S. The reason will be described hereinafter.

The plate-like face member 2 is likewise made of an olefin synthetic resin material. When the illustrated embodiment is constructed so as to act the plate-like face member 2 as the drawing faceplate, it may be transparent or semi-transparent.

The honeycomb core 5 is adhesively mounted at front and rear open end surfaces or open surfaces thereof onto a rear surface of the face member 2 and the core housing 3, respectively. This permits the honeycomb core 5 to be sealedly jointed between the core housing 3 and the face member 2. Also, the cells 4 of the honeycomb core 5 each have the plastic dispersion liquid 7 which is opaque white or translucent white and contains the magnetic particles encapsulated therein.

Now, the manner of sealedly joining the honeycomb core 5 between the core housing 3 and the plate-like face member 2 and encapsulating the plastic dispersion liquid 7 containing the magnetic particles in each of the cells 4 of the honeycomb core 5 will be described.

Figure 6A:
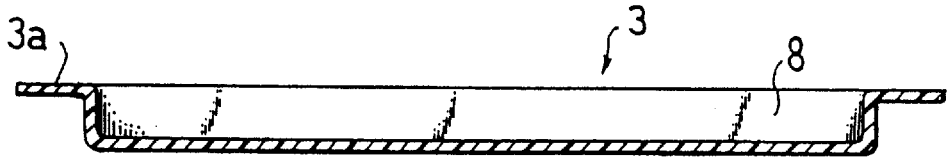
FIGS. 6A to 6E each are a schematic sectional view showing each of steps in an example of encapsulating of a plastic 5 dispersion liquid in a honeycomb core.
Figure 6B:
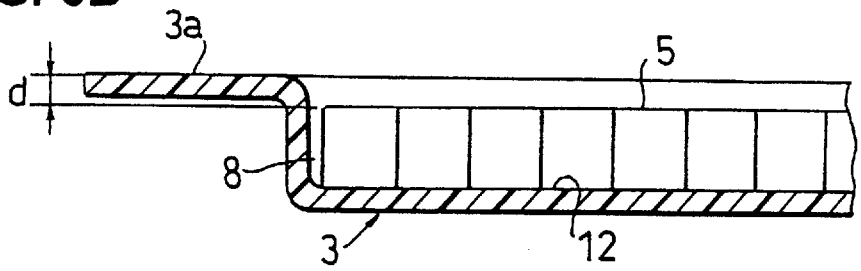
Figure 6C:
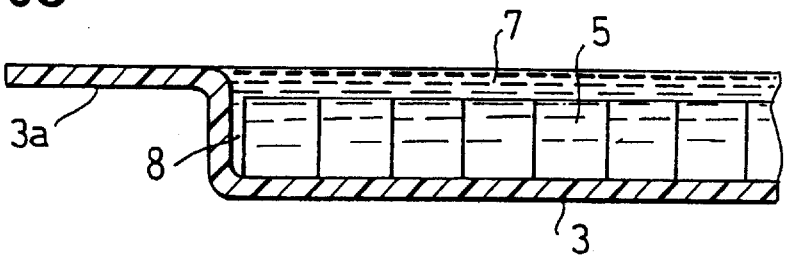

First of all, the honeycomb core 5 is securely received in the recess 8 of the core housing 3 by means of an adhesive 12, as shown in FIG. 6B. This is carried out by applying the adhesive 12 to a bottom surface of the recess 8 and then forcedly pressing the honeycomb core 5 onto the bottom surface of the recess 8. The adhesive 12 for bonding the core housing 3 and honeycomb core 5 together may be constituted by an adhesive suitable for bonding olefin synthetic resin and paper to each other. An adhesive of the thermosetting type such as a denatured or modified olefin hot-melt adhesive or the like may be used to this end. Alternatively, such a normal temperature curing adhesive as described below may be used. From a viewpoint of preventing deformation of the core housing 3, the normal temperature curing adhesive is preferably used because use of the thermosetting adhesive possibly causes thermal distortion of the core housing 3 which constitutes the drawing faceplate Then, as shown in FIG. 6C, the plastic dispersion liquid 7 is charged in the recess 8 of the core housing 3 while being fully stirred. The plastic dispersion liquid 7 may be made of any suitable material, so long as operation of contacting a distal end or tip of a magnetic pen with the drawing faceplate or moving an erasing bar with respect to the faceplate permits a magnetic field to act on the dispersion liquid 7 to rise the magnetic particles to the drawing faceplate or sink it in the recess 8 while being separated from the drawing faceplate, to thereby draw a display such as a picture or a character on the drawing faceplate or erase the display from the faceplate. The plastic dispersion liquid 7 may be made by compounding magnetic particles, a fine-particle thickening agent and a coloring agent in a dispersion medium, as known in the art.

The dispersion mediums include, for example, polar dispersion mediums such as water, glycol and the like, as well as non-polar dispersion mediums such as an organic solvent, oils and the like. The magnetic particles may be made of an oxide magnetic material such as black magnetite, γ-hematite, chromium dioxide, ferrite or the like or a metal magnetic material such as an alloy of iron, cobalt or nickel. The fine-particle thickening agents include, for example, finely powdered silicates such as anhydrous calcium silicate, water-containing calcium silicate, water-containing aluminum silicate, powdered silica, diatom earth, kaolin, clay, bentonite and a mixture thereof; alumina; micronized calcium carbonate; micronized activated calcium carbonate; heavy calcium carbonate; water-containing basic magnesium carbonate; barium sulfate and the like. The coloring agents include a white pigment, a dye and the like.

Encapsulation of the plastic dispersion liquid 7 in each of the cells 4 of the honeycomb core 5 is carried out by securely bonding the honeycomb core 5 onto the core housing 3 and then charging the plastic dispersion liquid 7 in the honeycomb core 5, followed by bonding of the plate-like face member 2 onto the honeycomb core 5.

When the upper end of the recess 8 of the core housing 3 is formed so as to be slightly higher than or slightly upwardly projected from the upper end of the honeycomb core 5, a liquid surface of the plastic dispersion liquid 7, as shown in FIG. 6C, is caused to reach the peripheral edge 3*a* of the recess 8 beyond the upper surface of the honeycomb core 5 in the case that the plastic dispersion liquid 7 containing the magnetic particles is charged in the recess 8 of the core housing 3.

Then, the plate-like face member 2 is adhesively fixedly bonded onto the honeycomb core 5. More specifically, the adhesive is applied to the rear surface of the plate-like face member 2. The adhesive which is cured at a normal temperature is preferably used in order to prevent deformation of the plate-like face member 2. Thus, an epoxy resin adhesive or a modified acrylic resin adhesive which is cured due to irradiation of ultraviolet rays thereon may be suitably used for this purpose. Selection of any one of two such adhesives is carried out depending on a period of time during which the bonding operation takes place.

Epoxy resins include various kinds of epoxy resins such as epoxy resin of the bisphenol-epichlorohydrin type obtained by a reaction between bisphenol or its derivative and epichlorohydrin, as well as that of the glycylester type, that of the phenolic novolak type and the like. The epoxy resin means an oligomer possessing two or more oxirane rings (epoxy groups) in a molecule thereof. Epoxy adhesives curing at a room temperature typically include a two-component adhesive such as a fast-setting epoxy adhesive or the like which is obtained, for example, by a combination of epoxy-polyamide or epoxy resin and a polymercaptan curing agent. However, a one-component type modified epoxy adhesive has been recently developed. An epoxy-modified polyamine adhesive may be used as a water-cured epoxy adhesive. Also, an epoxy resin adhesive exhibits satisfactory adhesion to substantially all materials. Further, it does not generally contain any volatile solvent, therefore, it is kept from shrinking or being reduced in volume after it cures. Also, it effectively prevents whitening or cracking of plastics or the like due to a solvent. In addition, the epoxy resin adhesive has a further advantage of being increased in resistance to chemicals, resistance to moisture and the like.

Such an epoxy resin adhesive is kept stationary until curing thereof is attained. In this instance, clamping may be readily carried out at a pressure as low as a contact pressure. In general, the epoxy resin adhesive is fully cured when it is left to stand for 24 hours at a room temperature. A period of time required for the curing may be reduced when the adhesive is heated for 30 to 60 minutes at a temperature of 60 to 100° C. Thus, the epoxy resin adhesive is advantageously used when adhering or bonding operation takes place for a long period of time.

An ultraviolet-curing adhesive absorbs ultraviolet energy, to thereby cause a photopolymerization reaction, resulting in curing, which adhesive is the radical polymerization type. The ultraviolet-curing adhesive mainly consists of an oligomer monomer such as unsaturated polyester, polyester acrylate, urethane acrylate, silicone acrylate or epoxy acrylate and a photopolymerization initiator of the benzoic ether, benzophenone, acetophenone or thioxanthone type. Also, it contains various additives added to each main components. Other ultraviolet-curing adhesives include an adhesive mainly consisting of polyethylene thiol, that mainly consisting of an epoxy resin/photo-decomposable onium salt of the cation polymerization type, and the like. Normally, ultraviolet rays do not reach an interface or mating surface between materials to be bonded. However, in the present invention, the plate-like face member 2 is made of a transparent olefin resin material which permits ultraviolet rays to permeate therethrough, so that such ultraviolet-curing adhesives as described above may be effectively used in the present invention.

Each of the above-described ultraviolet curing adhesive cures in seconds due to irradiation of ultraviolet rays thereon, to thereby attain automating of a manufacturing line and speeding-up thereof. Also, it exhibits further advantages of eliminating a necessity of any mixing operation because it is the one-component type, being increased in energy efficiency and providing a cured product which exhibits various properties such as increased flexibility, adhesion and resistance to chemicals, and the like. Thus, it permits the bonding operation to be accomplished in a short period of time.

Figure 6D:
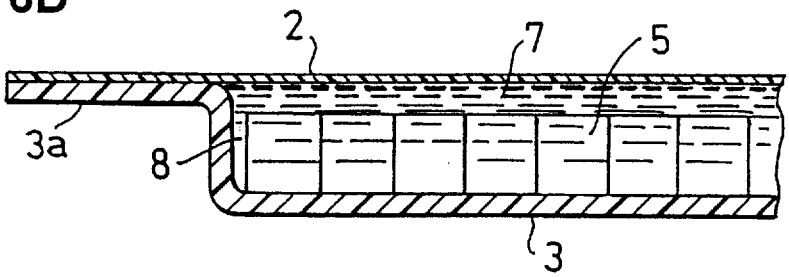
Figure 6E:
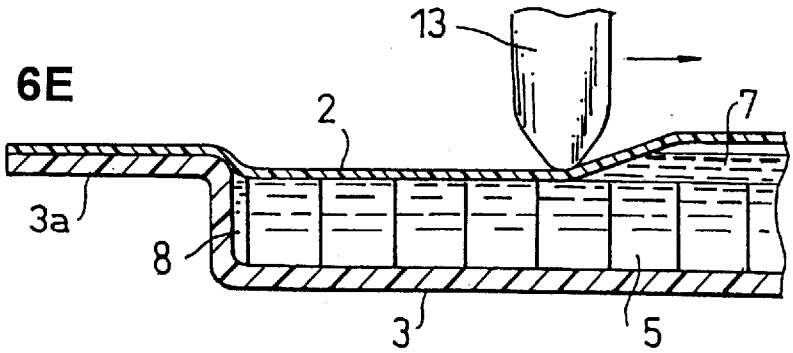

After the adhesive is applied to the rear surface of the plate-like face member 2 as described above, the plate-like face member 2 is superposedly placed on the core housing 3 as shown in FIG. 6D. Then, a suitable rod- or plate-like leveling-by-rubbing means 13 is slowly slid on the open surface of the honeycomb core 5 while the plate-like face member 2 is forced against the open surface by the leveling-by-rubbing means 13, as shown in FIG. 6E. The rubbing means 13 may be constructed so as to be rolled. This permits any extra or unnecessary portion of plastic dispersion liquid 7 to be removed from the recess 8 as in leveling-by-rubbing of powder and concurrently the plate-like face member 2 is forcedly bonded to the upper end surface of each of the cells 4 of the honeycomb 5, resulting in air being effectively prevented from intruding into the cells, so that the plastic dispersion liquid 7 may be satisfactorily encapsulated in the cells 4.

In this instance, the bonding operation must be carried out in a short period of time, therefore, an ultraviolet-curing adhesive is preferably used as the adhesive.

Figure 7:
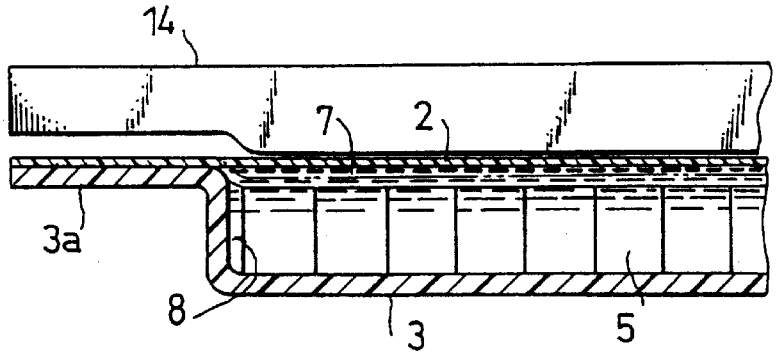
FIG. 7 is a fragmentary schematic sectional view showing another example of adhering of a plate-like face member to a honeycomb core.

Alternatively, the bonding may be carried out by pressedly fixing a press means 14 shown in FIG. 7 onto the open surface of the honeycomb core 5. In this instance, it is not required to execute the bonding operation in a short period of time, therefore, the epoxy resin adhesive rather than the ultraviolet-curing adhesive may be desirably used as the adhesive. Use of the epoxy resin adhesive permits clamping for press-fixing of the plate-like face member 2 on the honeycomb core 5 by means of the press means 14 to take place at a pressure as low as a contact pressure, resulting in the bonding operation being facilitated. The plate-like face member 2 is preferably previously formed to have a dish-like configuration depending on the different in height or level d between the upper end of the recess 8 and that of the honeycomb core 5 rather than a flat configuration.

When the level difference d between the upper end of the recess 8 of the core housing 3 and that of the honeycomb core 5 is reduced, any suitable leveling-by-rubbing means (not shown) formed to have a cylindrical shape may be slid or rolled at a relatively high speed along the open surface of the honeycomb core 5 in the same manner as in FIG. 6E while forcing the plate-like face member 2 against the honeycomb core 5, after the plastic dispersion liquid 7 is charged in the core housing 3. This permits any extra or unnecessary portion of the plastic dispersion liquid 7 exceeding the upper surface of the honeycomb core 5 to be removed from the recess 8 in substantially the same manner as in leveling-by-rubbing of powder. Concurrently, the plate-like face member 2 is bonded to the open surface of the honeycomb core 5 while being forced against the open surface, so that the plastic dispersion liquid 7 may be charged in the cells 4 of the honeycomb core 5. The plate-like face member 2 is bonded to the upper end of the honeycomb core 5 while pushing away the unnecessary portion of the plastic dispersion liquid 7 by the leveling-by-rubbing action, so that the thus-removed dispersion liquid 7 prevents ambient air from intruding between the plate-like face member 2 and the honeycomb core 5. This permits only the plastic dispersion liquid 7 to be encapsulated in the cells 4 of the honeycomb 5.

The press means 14 ensures positive encapsulation of the plastic dispersion liquid 7 in the cells 4 of the honeycomb core 5, whereas the leveling-by-rubbing means 13 permits the bonding operation to be rapidly carried out.

A portion of the plastic dispersion liquid above the honeycomb core 5 functions to prevent air from intruding into the honeycomb core 5 when the plate-like face member 2 is bonded to the honeycomb core 5, however, it is not charged in the honeycomb core 5, resulting in being extra or unnecessary. An excess of the unnecessary portion of the liquid not only increases resistance to movement of the leveling-by-rubbing means 13 but causes the plastic dispersion liquid 7 to generate waves when it is forced by the leveling-by-rubbing means 13, resulting in the honeycomb core 5 being possibly deformed by the thus-generated waves. Thus, it is required to restrict a speed of movement of the leveling-by-rubbing means 13, so that the bonding operation may not be rapidly carried out. Thus, the level difference d between the upper end of the honeycomb core 5 and that of the recess 8 is preferably reduced. The level difference d has an optimum value of about 0.01 mm. However, a practical value of the level difference d is preferably 0.1 mm or less. Of course the level difference d of 0 mm is deleted. Thus, it is required to be more than 0 mm.

The honeycomb core 5 preferably has a thickness of between about 0.5 mm and about 5.0 mm. The thickness below 0.5 mm causes the magnetic particles to be externally observed through the plate-like face member 2 while the magnetic particles are kept sinking on the bottom of the cells 4, whereas the thickness above 5.0 mm requires to excessively increase magnetic force of the magnetic pen or erasing bar. The thickness has an optimum value of between 0.8 mm and 2.0 mm. Thus, a height of the recess 8 of the core housing 3 is rendered equal to a sum of a thickness of the honeycomb core 5 and the above-described level difference d.

As described above, encapsulation of the plastic dispersion liquid 7 in the cells 4 of the honeycomb core 5 is carried out by securely bonding the honeycomb core 5 onto the core housing 3, charging the plastic dispersion liquid 7 in the honeycomb core 5 and then bonding the plate-like face member 2 onto the honeycomb core 5. Thus, the core housing 3 is preferably formed to have a thickness larger than that of the plate-like face member 2. For example, the former may be about 0.2 mm and the latter may be about 0.1 mm. The core housing 3 constitutes the drawing faceplate, therefore, it is required to have a smooth surface and be kept from being deformed during the drawing operation. Thus, the core housing 3 is preferably increased in thickness. Whereas the plate-like face member 2 is required to be flexible to a degree sufficient to be bonded to the honeycomb core 5 while carrying out leveling-by-rubbing of the plastic dispersion liquid, thus, the face member 2 is preferably reduced in thickness.

The peripheral edge 3*a* of the core housing 3 is preferably formed to have a somewhat increased width. This permits an increase in bond strength between the core housing 3 and the plate-like face member 2 because the peripheral edge 3*a* of the core housing 3 also functions as a margin with respect to the peripheral edge of the plate-like face member 2. Also, such an increase in width of the peripheral edge 3*a*, when the core housing 3 is incorporated in a display means such as a frame therefor or the like, minimizes a play between the core housing 3 and the display means, to thereby facilitate positional registration therebetween. Further, it facilitates operation of forming the peripheral edge 3*a* with holes through which the core housing 3 is secured to the display means.

Figure 8:
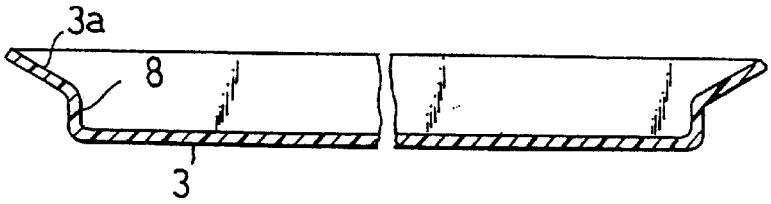
FIG. 8 is a partially cutaway vertical sectional view showing another example of a core housing.
Figure 9A:
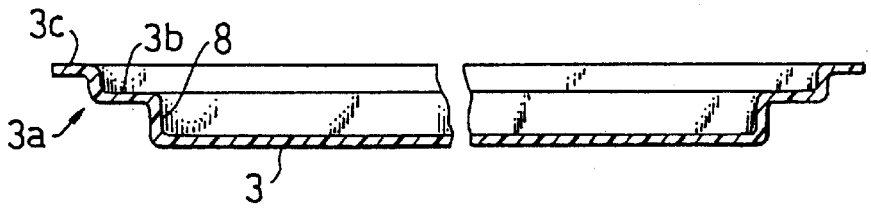
FIGS. 9A and 9B each are a partially cutaway schematic sectional view showing another example of encapsulating of a plastic dispersion liquid in a honeycomb core.
Figure 9B:
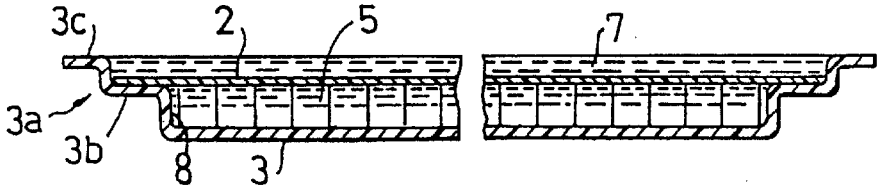

The manner of encapsulation of the plastic dispersion liquid 7 in the core housing 3 by leveling-by-rubbing is not limited to that described above. For example, as shown in FIG. 8, the peripheral edge 3*a* of the core housing 3 may be formed so as to be inclined. Alternatively, as shown in FIG. 9A, the peripheral edge 3*a* of the core housing 3 may be formed to have a two-step structure including a lower step 3*b* and an upper step 3*c*, wherein the lower step 3*b* of the two-step peripheral edge 3*a* may be constructed so as to function as the upper end of the honeycomb core 5 as well. In this instance, as shown in FIG. 9B, the plastic dispersion liquid 7 containing the magnetic particles is charged in the core housing 3 so that a level of the liquid 7 reaches an upper surface of the upper step 3*c* and then the plate-like face member 2 is placed on the honeycomb core 5. At this time, the plate-like face member 2 is superposed at the peripheral edge thereof on the lower step 3*b* of the honeycomb core 5. Then, the leveling-by-rubbing means is operated in substantially the same manner as described above, so that the plate-like face member 2 is bonded to the honeycomb core 5 and concurrently an unnecessary portion of the plastic dispersion liquid 7 is removed. This results in the plastic dispersion liquid 7 being satisfactorily encapsulated in the cells 4 of the honey comb core 5.

Figure 10:
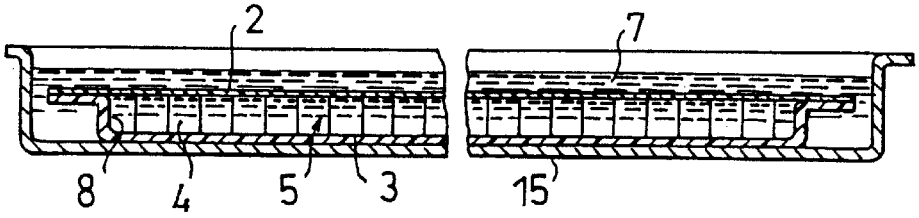
FIG. 10 is a partially cutaway schematic sectional view showing still another example of encapsulating of a plastic dispersion liquid in a honeycomb core.

Alternatively, the encapsulation may be carried out as shown in FIG. 10. More particularly, the honeycomb core 5 which is formed to have a thickness equal to a height of the recess 5 of the core housing 3 is securely received in the recess 8 to form a sub-assembly and then the sub-assembly is arranged in a panel housing 15 which is formed to have a size larger than the core housing 3, followed by secure bonding of the plate-like face member 2. In this instance, when the plastic dispersion liquid 7 containing the magnetic particles is charged in the panel housing 15, a level of the liquid 7 reaches an upper end of a peripheral wall of the panel housing 15 beyond the upper surface of the honeycomb core 5. Then, the leveling-by-rubbing means or press means is operated in substantially the same manner as described above to move the plate-like face member 2 along the open surface of the honeycomb core 5 or force the former against the latter, so that the plate-like face member 2 may be forcedly bonded to the upper end surface of the cells 4 of the honeycomb core 5 in the plastic dispersion liquid 7 while preventing intrusion of air into the plastic dispersion liquid 7. An extra or unnecessary portion of the plastic dispersion liquid 7 may be removed after the bonding.

In the illustrated embodiment, the plate-like face member 2 is substantially plane and the peripheral edge of the face member 2 is substantially prevented from being deformed, resulting in ensuring bonding between the plate-like face member 2 and the honeycomb core 5. Also, a height of a peripheral wall of the panel housing 15 may be determined irrespective of a height of the core housing 3 and the like, so that an increase in height of the peripheral wall of the panel housing 15 may ensure satisfactory vibration and stirring of the plastic dispersion liquid 7 charged therein, to thereby permit microsized bubbles as well as large bubbles taken in the plastic dispersion liquid 7 during the charging to be discharged to an ambient atmosphere.

Bonding of the plate-like face member 2, core housing 3 and honeycomb core 5 is preferably carried out using a room temperature curing acrylic adhesive or an ultraviolet curing adhesive. Use of a thermosetting adhesive is not desirable because it possibly causes the core housing 3 constituting the drawing faceplate to be thermally distorted or deformed.

Figure 11A:
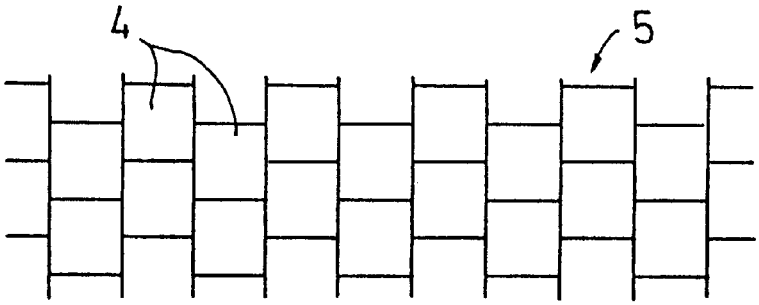
FIGS. 11A to 11C each are a fragmentary plan view showing another example of a core block.
Figure 11B:
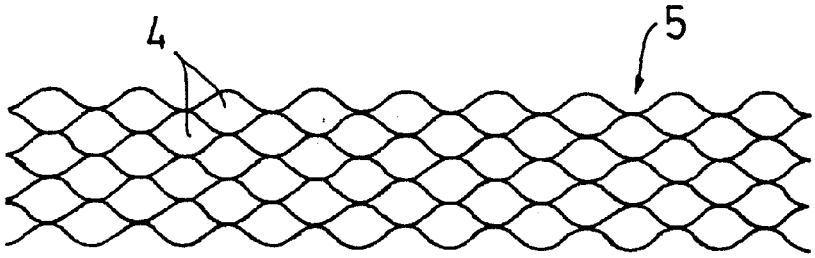
Figure 11C:
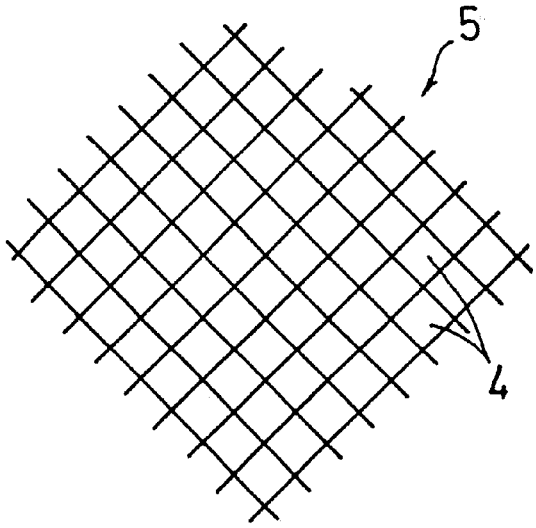
Figure 12A:
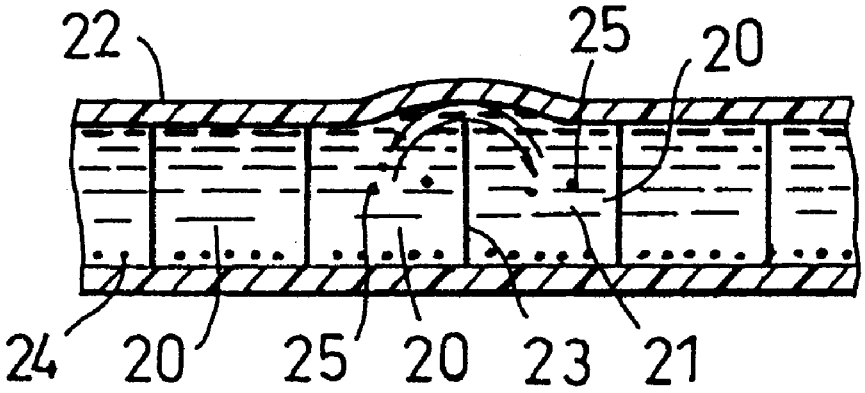
FIGS. 12A and 12B each are a fragmentary sectional view showing growth of bubbles generated when cells of a honeycomb core communicate with each other.
Figure 12B:
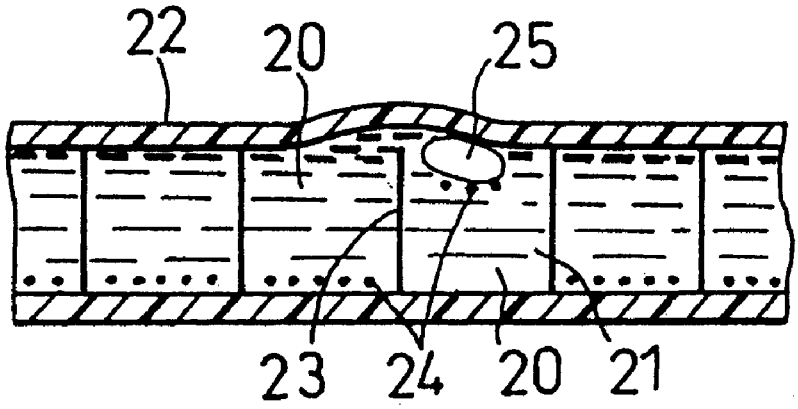

In the core block 5 sealedly joined between the core housing 3 and the plate-like face member 2, the cells 4 are not limited to the honeycomb core constructed into a honeycomb structure. For example, the cells 4 each may be formed to have a rectangular shape as shown in FIG. 11A. Alternatively, they may be formed in such a manner that waves are alternately contiguous to each other, as shown in FIG. 11B. Further, the cells 4 each may be formed to have a diamond-like shape or rhombus shape as shown in FIG. 11C.

When the core housing 3 and plate-like face member 2 each are made of an olefin resin material, they are advantageously reduced in water absorption properties. However, they are deteriorated in bonding properties. As a result of carefully repeating an experiment, it was found that a vinyl acetate resin adhesive, an acrylic resin adhesive or an ultraviolet-curing adhesive may be suitably used for this purpose. In particular, it was found that the vinyl acetate resin adhesive exhibits increased bonding properties with respect to paper. Solidification of the vinyl acetate resin adhesive is carried out by dissipation of a solvent contained therein, to thereby require that at least one of materials to be bonded together is porous. In this connection, the honeycomb core 5 is made of paper, therefore, fibers of the paper constituting the honey comb would permit the solvent contained in the vinyl acetate resin adhesive to be outwardly.removed therethrough from the adhesive.

As described above, the honeycomb core 5, core housing 3 and plate-like face member 2 are bonded together by means of the adhesive. Thus, the bonding does not require to finely control a heating temperature, to thereby significantly increase manufacturing efficiency.

The magnetic display panel 1 of illustrated embodiment, as described above, is constructed by combining an olefin synthetic resin material of which the core housing 3 and plate-like face member 2 are formed and a paper material of which the honeycomb core 5 is made with each other. The magnetic display panel 1 thus constructed is applied to only infants. Thus, it would be considered that infants strongly strikes the drawing faceplate of the magnetic display panel 1 with a tip of a magnetic pen.

In such a case, impact of the magnetic pen is transmitted from the core housing 3 constituting the drawing faceplate to the honeycomb core 5. The honeycomb core 5 is made of a paper material which is inherently soft or flexible, to thereby function as a cushion when the impact is applied thereto, so that the impact may be softly absorbed by the core housing 3 and honeycomb core 5. Therefore, the magnetic display panel 1 is constructed so as to absorb the impact by a peripheral portion thereof, to thereby prevent it from being locally concentrated, resulting in being hard to break. Thus, even when infants strongly strikes the core housing 3 of the magnetic display panel 1 with the tip of the magnetic pen, the magnetic display panel 1 positively prevents the plastic dispersion liquid 7 from leaking is from the core housing 3, resulting in effectively eliminating accidents such as adhesion of the liquid to clothing, drinking of the liquid by infants, getting of the liquid in the eyes and the like.

Also, the honeycomb core 5 is made of a paper material, so that it may be increased in workability as compared with the conventional honeycomb core made of vinyl chloride, to thereby be reduced in thickness to a degree one half as large as that of the conventional honeycomb. This permits a ratio of the end surface of each of the cells 4 of the honeycomb core 5 to the drawing faceplate being significantly reduced, resulting in an effective area of the drawing faceplate being increased correspondingly.

Also, a reduction in area of the end surface of the cells 4 permits a reduction in reflecting surface by which external light is reflected. Also, glassine paper is reduced in thickness and weight and increased in transparency, to thereby permit light to permeate therethrough as compared with normal paper. Also, it exhibits highly increased resistance to oils as compared with other paper materials. In addition, glassine paper is further increased in transparency when it is impregnated with the plastic dispersion liquid 7, resulting in boundary between cells adjacent to each other being indistinct. This permits a honeycomb configuration of the honeycomb core 5 to be hard to appear on the drawing faceplate, to thereby provide homogeneous and integral display. Further, the magnetic display panel of the illustrated embodiment permits a reduction in thickness of the honeycomb core 5, to thereby substantially prevent or minimize intrusion of the magnetic particles between the end surface of the cells of the honey comb core 5 and the rear surface of the core housing 3 during bonding between the core housing 3 and the honeycomb core 5 having the plastic dispersion liquid 7 containing the magnetic particles charged therein. This permits drawing efficiency to be remarkably enhanced. The same advantage may be obtained by use of parchment paper as well.

Further, when the magnetic display panel 1 is so constructed that the coloring agent contained in the plastic dispersion liquid has a color similar to that of the honeycomb core 5 or normally both are white, a configuration of the cells 4 of the honeycomb core 5 projected or appearing on the drawing faceplate is permitted to be apparently dissipated therefrom, so that the whole drawing faceplate may have the same color.

Deformation of the core housing 3 occurs due to bending of a part of the core housing into a configuration like a curved surface, unlike that of the conventional core housing due to bending thereof at an angle beyond an elastic limit. This permits the core housing 3 to be restored to its original plane configuration by its inherent elasticity after impact is applied thereto. In this instance, the honeycomb core 5 deformed is more readily restored to its original shape with the assistance of the restoring force of the core housing 3.

The honeycomb core 5 is made of a paper material, to thereby exhibit increased adhesion properties, resulting in the core housing 3, plate-like face member 2 and honeycomb core 5 being rigidly bonded together. This prevents impact which infants usually apply to the honeycomb core 5 from being transmitted through the cells 4 adjacent to each other to cause problems such as indistinct drawing, leakage of the liquid and the like, resulting in ensuring clear drawing.

In addition, the honeycomb core 5 is made of paper, to thereby render charging of static electricity thereon substantially impossible. This prevents flowing of the magnetic particles from being deteriorated by static electricity, to thereby permit distinct lines to be smoothly and clearly drawn on the honeycomb core 5.

Moreover, the core housing 3 and plate-like face member 2 of the magnetic display panel 1 each are made of olefin synthetic resin and the honeycomb core 5 is made of paper. Thus, disposal of the waste magnetic display panel 1 by incineration does not cause generation of dioxin.

It is not necessarily required that the plate-like face member 2 is made of olefin synthetic resin. It may be made of vinyl chloride resin as in the prior art vinyl chloride exhibits increased workability and adhesion properties. Thus, even when vinyl chloride is used for the plate-like face member, the honeycomb core 5 is made of paper and the core housing is made of olefin synthetic resin, resulting in reducing impact of the magnetic display panel to the environment.

In the magnetic display panel of the present invention, when infants strongly strike the drawing faceplate of the magnetic display panel with a tip of a magnetic pen, impact of the magnetic pen is transmitted from the core housing constituting the drawing faceplate to the core block. In this instance, the core block is made of paper which is relatively soft and flexible, to thereby exhibit a cushion function, so that the impact may be absorbed by the core block due to deformation thereof, to thereby substantially prevent undesired formation of holes in the drawing faceplate. This prevents leakage of the plastic dispersion liquid from the core block, resulting in problems such as adhesion of the liquid to clothing, drinking of the liquid by infants, getting of the liquid in the eyes and the like being effectively eliminated, to thereby ensure sufficient safety to the body of infants When the impact is applied to the drawing faceplate of the magnetic display panel, the core housing and core block are permitted to be deformed into a curved surface-like shape. This permits the core housing to be readily restored to the original configuration, leading to an increase in durability of the magnetic display panel.

Also, the-core block is made of paper, to thereby permit the adhesive to penetrate into fibers forming the open end surface of the core block, so that the core block and core housing may be firmly bonded together to a degree sufficient to prevent breakage of bonding between the core housing and the core block due to application of impact thereto from a magnetic pen or the like. Thus, the magnetic display panel of the present invention eliminates troubles such as leakage of the plastic dispersion liquid, indistinct display and the like due to application of impact to the core block by infants, resulting in durability thereof being enhanced.

In addition, the core block is made of paper, to thereby minimize charging of static electricity thereon. This eliminates a deterioration in flowing of the magnetic particles due to the charging, to thereby ensure smooth drawing of clear lines.

Further, formation of paper into the core block permits a thickness of the core block to be reduced to a degree about one half as large as that of the conventional core block made of vinyl chloride, leading to a decrease in ratio of the end surface of the core block to the drawing faceplate, resulting in an effective area of the drawing faceplate being increased correspondingly. Also, a reduction in area of the end surface not only permits a reduction in reflecting surface by which external light is reflected but renders arrangement of the magnetic particles on the end surface and drawing faceplate hard when the magnetic particles and the like are encapsulated in the cells of the core block. In addition, the paper satisfactorily absorbs light, to thereby render a configuration of the end surface of the core block hard to be projected or appear on the drawing faceplate, leading to a significant increase in drawing efficiency.

Moreover, the core housing and plate-like face member each are made of olefin synthetic resin and the core block is made of paper. Thus, disposal of the magnetic display panel by incineration after it is waste prevents generation of dioxin which causes environmental pollution, harm to the health and the like.

Also, in the embodiment of the present invention, the core block is made of glassine paper or parchment paper which is increased in transparency to permit light to permeate therethrough and permits the plastic dispersion liquid to be satisfactorily impregnated therein, so that it is hard to externally observe a boundary between the cells adjacent to each other. It is hard for a configuration of the cells of the core block to appear on the drawing faceplate, so that the drawing faceplate may provide a homogeneous and integral picture plane. In addition, the core block is reduced in thickness, resulting in substantially preventing intrusion of the magnetic particles between the end surface of the cells of the core block and the rear surface of the core housing during bonding between the core housing and the core block charged therein with the plastic dispersion liquid containing the magnetic particles. This significantly enhances drawing efficiency.

Further, in the embodiment of the present invention, the core housing may be made of any one selected from the group consisting of polyethylene, PET and polypropylene, resulting in being increased in transparency and strength.

Also, in the embodiment of the present invention, the adhesive may be selected from the group consisting of a vinyl acetate adhesive, an acrylic adhesive and an ultraviolet-curing adhesive, so that a width of selection of the adhesive may be increased.

In the embodiment of the present invention, the upper end of the recess of the core housing is formed so as to be higher than the upper end of the core block. Thus, production of the magnetic display panel may be carried out by leveling-by-rubbing the plastic dispersion liquid while keeping the plastic dispersion liquid overflowing the cells of the core block in the core housing. This prevents air from intruding into the magnetic display panel, resulting in the magnetic display panel being provided with increased performance and durability.

The embodiment of the present invention is so constructed that a difference in dimension between the upper end of the recess of the core housing and the upper end of the core block is 0.1 mm or less. Such construction permits operation of bonding the plate-like face member to the core block to be rapidly attained while effectively preventing intrusion of air into the cells of the core block.

In the embodiment of the present invention, the coloring agent and core block have a similar color, to thereby permit a configuration of the cells of the core block projected on the drawing faceplate to be apparently dissipated, resulting in the whole drawing faceplate having the same color.

In addition, in the method for manufacturing the magnetic display panel according to the present invention, bonding between the core block and the core housing and plate-like face member is carried out by means of the adhesive. This eliminates a necessity of finely controlling a heating temperature in the manufacturing, to thereby enhance manufacturing efficiency.

The core block is made of paper, so that the adhesive for bonding the plate-like face plate and core block to each other may penetrate into fibers constituting the open end surface of the core block, resulting in the plate-like face member and core block being firmly bonded together. This permits the plastic dispersion liquid to be positively encapsulated in the cells. Thus, the magnetic display panel of the present invention exhibits strength sufficient to withstand impact applied thereto when infants strikes it with a magnetic pen and ensures drawing of clear lines.

In the embodiment of the method of the present invention, the adhesive used is a room temperature curing adhesive, so that it is not required to heat the core housing, to thereby prevent deformation of the core housing. This ensures smooth sliding or movement of a magnetic pen on the core housing, so that the magnetic display panel may be increased in commercial value.

In the embodiment of the method of the present intention, the adhesive used is an ultraviolet-curing adhesive which cures in seconds, so that the bonding operation may be rapidly attained.

In the embodiment of the method of the present invention, the core block is constituted by the honeycomb core, so that the core block may be stably manufactured and increased in strength.

In the embodiment of the method of the present intention, bonding of the plate-like face member to the core block is carried out by moving the face member along the open surface of the core block while forcing the face member against the open surface using any suitable means, resulting in the bonding operation being rapidly executed.

In the embodiment of the method of the present invention, the plate-like face member is forced against the open surface of the core block using any suitable means during bonding of the face plate to the open surface of the core block, so that the plate-like face member may be positively bonded to the core block in the plastic dispersion liquid without deforming the peripheral edge of the plate-like face member, resulting in the plate-like face member being substantially plane.

What is claimed is:

1. A magnetic display panel, characterized in that the panel comprises:

a core housing which has a peripheral edge formed to have an increased height and is formed therein with a recess;

a face member arranged so as to cover said recess of said core housing; and a core block provided with a number of cells in which a plastic dispersion liquid containing magnetic particles is encapsulated and sealedly joined between said core housing and said face member by means of an adhesive;

said core housing and plate-like face member each being made of olefin synthetic resin;

one of said core housing and face member constituting a drawing faceplate which is formed to be transparent or semi-transparent;

said core block being formed of pulp made paper.

2. A magnetic display panel as defined in claim 1, wherein said core block is formed of glassine paper.

3. A magnetic display panel as defined in claim 1, wherein said core block is formed of parchment paper.

4. A magnetic display panel as defined in any one of claims 1 to 3, wherein said core housing is formed of polyethylene terephthalate.

5. A magnetic display panel as defined in any one of claims 1 to 3, wherein said core housing is formed of polyethylene.

6. A magnetic display panel as defined in any one of claims 1 to 3, wherein said core housing is formed of polypropylene.

7. A magnetic display panel as defined in any one of claims 1 to 3, wherein said adhesive is an vinyl acetate resin adhesive.

8. A magnetic display panel as defined in any one of claims 1 to 3, wherein said adhesive is an acrylic resin adhesive.

9. A magnetic display panel as defined in any one of claims 1 to 3, wherein said adhesive is an ultraviolet-curing adhesive.

10. A magnetic display panel as defined in any one of claims 1 to 3, wherein said recess of said core housing has an upper end formed to be higher than an upper end of said honeycomb core.

11. A magnetic display panel as defined in claim 10, wherein a difference in height between said upper end of said recess of said core housing and that of said honeycomb core is set to be larger than 0 and 0.1 mm or less.

12. A magnetic display panel as defined in any one of claims 1 to 3, wherein said plastic dispersion liquid contains a coloring agent which has a color similar to that of said core block.

13. A method for manufacturing a magnetic display panel, comprising the steps of:

forming olefin synthetic resin into a core housing which has a peripheral edge formed to have an increased height and is formed therein with a recess;

arranging a core block in said recess of said core housing, said core block being made of paper and provided with a number of cells;

bonding said core block and said recess of said housing to each other by means of an adhesive;

charging a plastic dispersion liquid containing magnetic particles in said core block;

arranging a face member in a manner to be opposite to said core housing with said core block being interposed between said face member and said core housing, said face member being made of olefin synthetic resin;

applying an adhesive to a rear surface of said face member; and bonding said rear surface of said face member to an open surface of said core block to encapsulate said plastic dispersion liquid in said cells.

14. A method for manufacturing a magnetic display panel as defined in claim 13, wherein said adhesive is a room temperature curing adhesive.

15. A method for manufacturing a magnetic display panel as defined in claim 13, wherein said adhesive is an ultraviolet-curing adhesive.

16. A method for manufacturing a magnetic display panel as defined in claim 14, wherein said adhesive is a vinyl acetate adhesive.

17. A method for manufacturing a magnetic display panel as defined in claim 14, wherein said adhesive is an acrylic adhesive.

18. A method for manufacturing a magnetic display panel as defined in any one of claims 13 to 17, wherein said core block is a honey comb.

19. A method for manufacturing a magnetic display panel as defined in any one of claims 13 to 17, wherein said step of bonding said face member to said open surface of said core block is carried out by moving said face member along said open surface of said core block while forcing said face member against said open surface of said core block using any suitable means.

20. A method for manufacturing a magnetic display panel as defined in any one of claims 13 to 17, wherein said step of bonding said face member to said open surface of said core block is carried out by forcing said face member against said open surface of said core block using any suitable press means.

21. A method for manufacturing a magnetic display panel as defined in claim 13, wherein said step of charging a plastic dispersion liquid comprises adding said dispersion liquid in said core block such that the level of said plastic dispersion liquid is above an upper surface of said core block.

22. A method for manufacturing a magnetic display panel as defined in claim 13, wherein said step of bonding said core block-and said recess of said housing comprises the sub step of removing an excess portion of said plastic dispersion liquid above an upper surface of said core block.

23. A magnetic display panel for providing images by application of a magnetic field comprising:

a core housing including a bottom surface and a perimeter side wall;

a core block provided with a plurality of flexible cells made of paper mounted on the bottom surface and between the perimeter side wall;

a liquid having magnetic particles contained within each cell; and a face plate member mounted on the core housing to seal the core block and liquid in the core housing, the core block encapsulated and sealingly joined between the bottom surface of the core housing and the face plate by an adhesive, wherein application of a magnetic field can attract the magnetic particles to form an image, wherein the core housing and the face plate member are formed of an olefin synthetic resin.

24. The magnetic display panel of claim 23 wherein the core housing and the face plate member are made of a material selected from the group consisting of polyethylene, polyethylene terephthalate, polypropylene, and polybutene.

25. The magnetic display panel of claim 23 wherein the core block is made from a water resistant and oil resistant paper of a honeycomb configuration having a weight within a range of 25 g/m2 and 50 g/m2.

26. The magnetic display of claim 25, wherein the thickness of the core block cell wall is about 30 $\mu$m to 40 $\mu$m.

* * * * *